US011541678B2

(12) United States Patent
Canacci et al.

(10) Patent No.: US 11,541,678 B2
(45) Date of Patent: Jan. 3, 2023

(54) STRATIFIED ITEM FOR PRINTING WITH SUBLIMATION INKS AND METHOD FOR PRODUCING IT

(71) Applicant: SISER S.R.L., Vicenze (IT)

(72) Inventors: Alessandro Canacci, Vicenze (IT); Marco Cazzola, Vicenze (IT)

(73) Assignee: Siser S.R.L., Vicenze (IT)

( * ) Notice: Subject to any disclaimer, the term of this patent is extended or adjusted under 35 U.S.C. 154(b) by 609 days.

(21) Appl. No.: 16/146,056

(22) Filed: Sep. 28, 2018

(65) Prior Publication Data

US 2019/0338145 A1 Nov. 7, 2019

(51) Int. Cl.

| | |
|---|---|
| ***B41M 5/52*** | (2006.01) |
| ***B41M 5/44*** | (2006.01) |
| ***D06P 5/24*** | (2006.01) |

(52) U.S. Cl.

CPC ..... *B41M 5/5272* (2013.01); *B41M 5/44* (2013.01); *B41M 5/5254* (2013.01); *B41M 5/5263* (2013.01); *B41M 5/5281* (2013.01); *D06P 5/003* (2013.01); *B41M 2205/02* (2013.01); *B41M 2205/32* (2013.01)

(58) Field of Classification Search

CPC ..... B41M 5/5254; B41M 5/5263; B41M 5/5272; B41M 5/5281; B41M 5/44; B41M 2205/02; B41M 2205/32; D06P 5/003

See application file for complete search history.

(56) References Cited

U.S. PATENT DOCUMENTS

2008/0302470 A1* 12/2008 Sumita ..... B44C 1/17 156/241

* cited by examiner

*Primary Examiner* — Gerard Higgins

(74) *Attorney, Agent, or Firm* — Harness, Dickey & Pierce PLC

(57) ABSTRACT

A stratified support item for printing on a surface with sublimation inks is disclosed. The surface may include, for example, clothing items, such as T-shirts, sweatshirts or the like. The stratified support item includes a thermo-adhesive layer configured to adhere to the surface and at least one finish layer configured to receive said sublimation inks. The finish layer includes a powder, which is comprised of at least one from the group of (i) a polyester powder, and (ii) a polyamide powder, incorporated in a matrix of polymeric material.

27 Claims, 5 Drawing Sheets

STRATIFIED ITEM FOR PRINTING WITH SUBLIMATION INKS AND METHOD FOR PRODUCING IT

CROSS-REFERENCE TO RELATED APPLICATIONS

This application claims the benefit of Italian Application No. 102018000005034 filed on May 3, 2018.

TECHNICAL FIELD OF THE INVENTION

The present invention concerns the field of the execution of prints on objects. More specifically, the present invention concerns the decoration of surfaces, for example of fabrics, clothing items and/or accessories, suited to be subjected to heat treatments. In greater detail, the present invention concerns an item provided with a film able to receive sublimation inks for printing objects, such as fabrics in general, with said inks, as well as a method for producing and/or making said item.

BACKGROUND

Several techniques for decorating objects made of fabric in general, such as T-shirts, sweatshirts, hats, shoes, trousers, bags or clothing items and/or similar accessories are known in the art.

The known techniques for decorating fabrics include traditional printing techniques, according to which the desired decorations (words, images or the like) are obtained through the direct application of suitable inks to the fabrics themselves, for example using stencil techniques. On the other hand, other techniques developed more recently are equally known, according to which the desired images or decorations are not created directly on the fabrics, but rather on printing supports that are successively applied to the fabrics through the simultaneous application of heat and pressure. These techniques are appreciated also because printing on printing supports is much easier than printing directly on fabric, wherein printing on printing supports means being able to obtain decorations of the most varied types and shapes. In practice, printing supports comprise at least one layer, the so-called finish layer, which is suited to receive inks (more specifically, sublimation inks), and at least one thermo-adhesive layer; the desired decoration, in fact, is printed on the finish layer, wherein the support is successively laid on the fabric or clothing item in the desired position and with the thermo-adhesive layer in contact with the fabric or clothing item, and applied (fixed) to the latter through the application of heat and pressure, thus making the thermo-adhesive layer adhere to the fabric or clothing item. The printing process just described above allows decorations to be applied to fabrics or clothing items in a reliable manner and practically without any risk of undesired detachment.

The printing supports of the known type suited to receive sublimation inks comprise, for example, sublimation papers or polyester flocks or polyester fabrics. Sublimation papers are printed with sublimation inks and then, through the application of heat, the inks are transferred through sublimation onto the final object, which must be made of a polyester fabric.

Application through heat requires application temperatures exceeding 180° C. for more than 15 seconds and the use of a special press. Polyester flock comprises a layer constituted by polyester fibers with a hairy surface aspect, which is printed with sublimation inks, after which the inks are fixed to the final object through the application of heat.

Application through heat requires, again, application temperatures exceeding 180° C. for more than 15 seconds and the use of a special press. The hot transfer process promotes the sublimation of the inks, which are fixed to the polyester fibers. Polyester fabric comprises a layer consisting of woven polyester fibers, for example warp and weft, with a fibrous surface aspect, which is printed with sublimation inks, after which, through the application of heat, the inks are fixed to the final object.

Application through heat requires, again, application temperatures exceeding 180° C. for more than 15 seconds and the use of a special press. The hot transfer process promotes the sublimation of the inks, which are fixed to the fibers of the fabric. However, the printing methods according to the known art, more specifically the printing supports according to the known art, pose some drawbacks, in some cases such drawbacks that limit their use considerably.

A drawback posed by the known technique is related to the fact that high temperatures and/or long transfer times force the customer to change the settings of the press, which results in an unavoidable increase in the processing times. Another drawback of the known technique is related to the fact that sometimes the object/fabric to be decorated is damaged as a consequence of the heat treatment, more specifically due to the high temperature to which it is subjected. Another drawback is related to the fact that the portion of the object/fabric occupied by the decoration becomes more rigid than the other portions of the object and this rigidity is perceived as a nuisance by the users of the object, especially in the case of fabrics used for valuable clothing items.

A further drawback is related to the fact that in some cases, for example when sublimation papers are used, the object to be processed must be made of a polyester fabric, thus limiting the range of objects to which said printing technique can be applied.

Further drawbacks and/or inconveniences of the printing supports known in the art are related to their production methods, which in some cases are very complicated.

Finally, also as a consequence of the necessary printing temperatures and/or times, the printing process considerably affects the production cost of the final objects.

Accordingly, there is a need for a printing support that improves upon at least some of the limitations described above.

SUMMARY

A stratified support item for printing on a surface with sublimation inks is disclosed. The surface may include, for example, clothing items, such as T-shirts, sweatshirts or the like. The stratified support item includes a thermo-adhesive layer configured to adhere to the surface and at least one finish layer configured to receive said sublimation inks. The finish layer includes a powder, which is comprised of at least one from the group of (i) a polyester powder, and (ii) a polyamide powder, incorporated in a matrix of polymeric material.

BRIEF DESCRIPTION OF THE FIGURES

Certain embodiments of improved printing support will be described in connection with the figures described hereinbelow. It should however be noted that the present invention is not limited to the embodiment illustrated in the drawings; on the contrary, all those variants or modifications of the embodiment illustrated and described herein that are clear, obvious and immediate for the expert in the art fall within the scope and sphere of application of the present invention. In particular, in the attached drawings.

DETAILED DESCRIPTION

Figures 1, 1A:
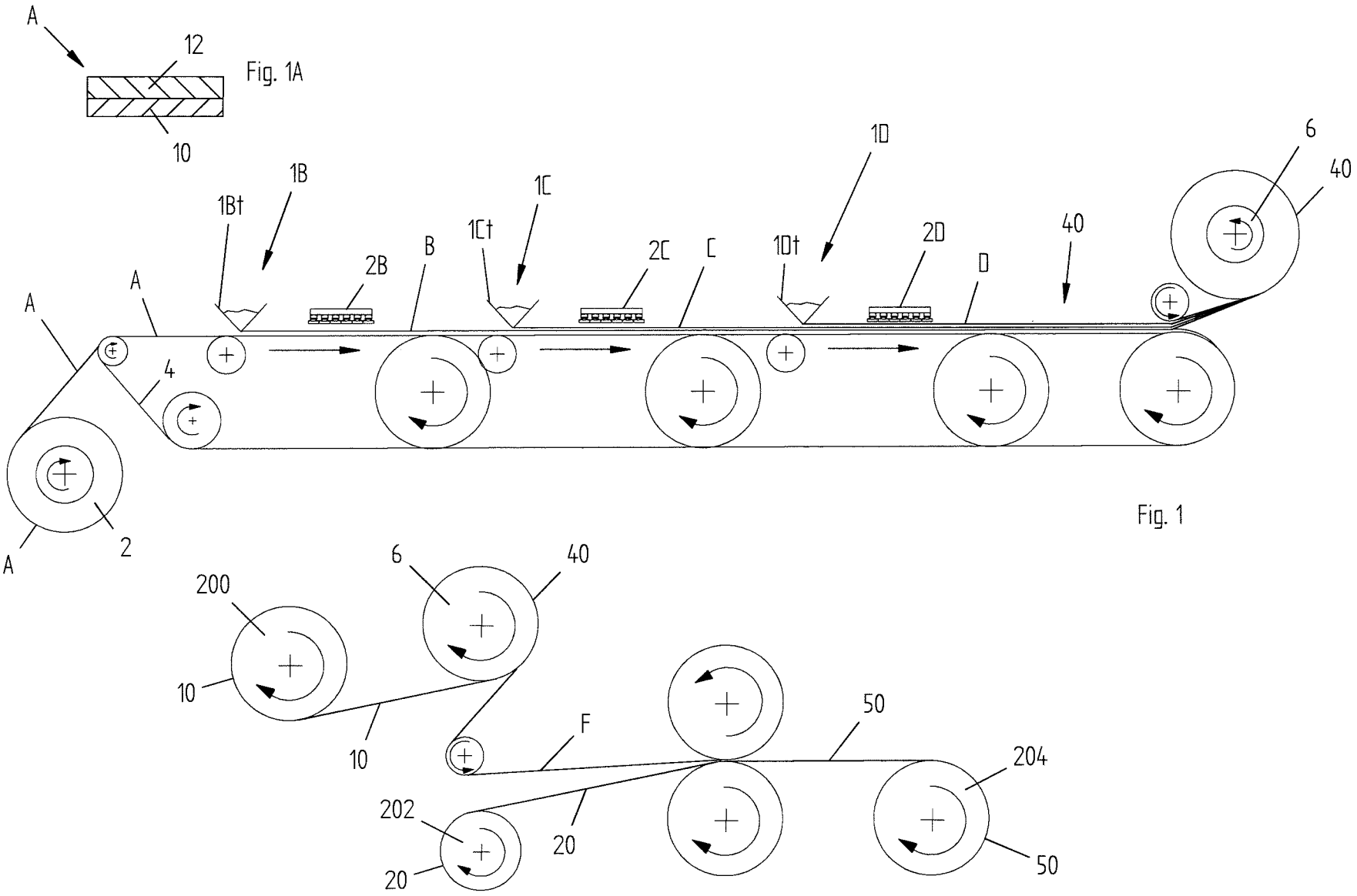
FIG. 1 shows a diagram illustrating the steps of the formation process of a support item according to one embodiment.

According to a first aspect, therefore, the subject of the same is a stratified support item for printing a surface with sublimation inks, more specifically for printing a surface of clothing items, such as T-shirts, sweatshirts or the like, said item comprising a thermo-adhesive layer suited to allow said item to be fixed to said surface and at least one finish layer suited to receive said sublimation inks, wherein said finish layer comprises polyester powder and/or polyamide powder incorporated in a matrix made of a polymeric material. Preferably, the powder comprises polybutylene terephthalate powder (PBT) and/or polyethylene terephthalate powder (PET) and/or PA powder. In one embodiment, the matrix made of a polymeric material comprises polymers of polyurethane and/or acrylic resin and/or vinyl resin.

According to an embodiment, the polyester powder and/or the polyamide powder is/are present in a weight percentage included between 20% and 80% with respect to the matrix made of a polymeric material, more preferably between 40% and 70%.

In an embodiment, the item comprises a support layer positioned in contact with the thermo-adhesive layer. Preferably, the thermo-adhesive layer comprises a thermoplastic layer, preferably a copolyester resin-based or polyurethane-based thermoplastic layer.

According to an embodiment, the item furthermore comprises an intermediate skin layer in contact with said thermo-adhesive layer and said finish layer. Preferably, the intermediate skin layer comprises polyurethane-based materials, preferably polyurethane (PU), or acrylic-based materials, or PVC, or LDPE. Preferably, the polyester powder and/or polyamide powder features a grain size of less than 500 micrometers, more preferably of less than 200 micrometers, even more preferably of less than 75 micrometers. The grains of the polyester powder and/or polyamide powder may have the shape of polyhedra. The polyester powder and/or polyamide powder may be obtained through a grinding and micronization process in a cryogenic process.

According to another aspect, the subject of the same is a method for producing an item according to the description provided above, wherein the method comprises a step in which said at least one finish layer and said thermo-adhesive layer are mutually coupled with each other, wherein said at least one finish layer is obtained starting from an amalgam comprising polyester powder and/or polyamide powder incorporated in a matrix made of a polymeric material. In one embodiment, said mutual coupling is obtained by spreading said at least one finish layer on the thermo-adhesive layer. Preferably, the finish layer is spread directly on the thermo-adhesive layer.

According to an embodiment, the method comprises a step of production of the intermediate skin layer which is formed by spreading an amalgam comprising polyurethane-based material on the thermo-adhesive layer. Preferably, said at least one finish layer is spread on the intermediate skin layer.

In an embodiment, the thermo-adhesive layer belongs to a preparation comprising also a coating support, said thermo-adhesive layer being pre-coupled to the coating support. Preferably, the coating support comprises a paper film, preferably a siliconised paper film. According to one embodiment, the method comprises the removal of the coating support after the formation of said at least one finish layer.

In an embodiment, the combination of the thermo-adhesive layer with the finish layer/s or the combination of the thermo-adhesive layer with the finish layer/s and the intermediate layer is arranged on a support layer, placing the thermo-adhesive layer in contact with the support layer. Preferably, the support layer comprises a polyester-based material.

According to an embodiment, the method comprises the printing of the most external layer of said at least one finish layer with sublimation inks. Preferably, according to the method of the invention, said polyester powder and/or polyamide powder features a grain size of less than 500 micrometers, more preferably of less than 200 micrometers, even more preferably of less than 75 micrometers. The grains of the polyester powder and/or polyamide powder may have the shape of polyhedra.

According to a further aspect of the present invention, the subject of the same is an object comprising a decorated surface, wherein the decoration of said decorated surface is obtained by applying an item as described above to said surface. Preferably, said object comprises a fabric of a clothing item.

Figure 2:
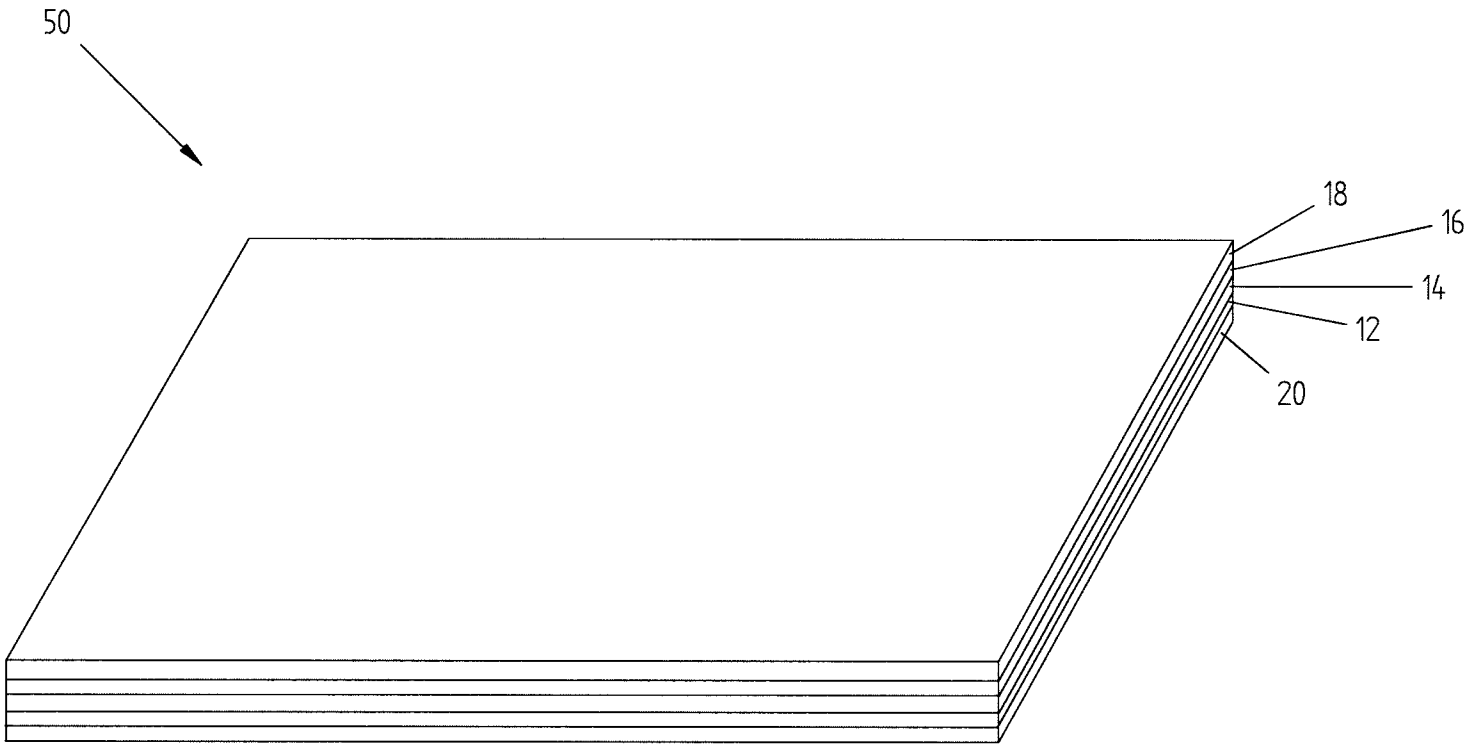
FIG. 2 shows an axonometric view of an item obtained by means of the process illustrated in FIG. 1.

Now, with reference to the figures, FIG. 1 shows an exemplary system 1 suited to produce an embodiment of the stratified item 50 according to an embodiment of the method. The item 50 according to an embodiment, obtained by means of said system 1, is shown, in particular, in FIG. 2. There, the item 50 is substantially represented in the form of a sheet, for example an A4 size sheet. However, the item which is the subject of the present invention can have any other desired shape and/or can be wound on a coil, in the form of a film ready to be cut to size. It should also be observed that, in order to facilitate the present description, in the figures the thicknesses of the various layers are merely indicative, and so are the proportions of the same with respect to one another.

Figure 3:
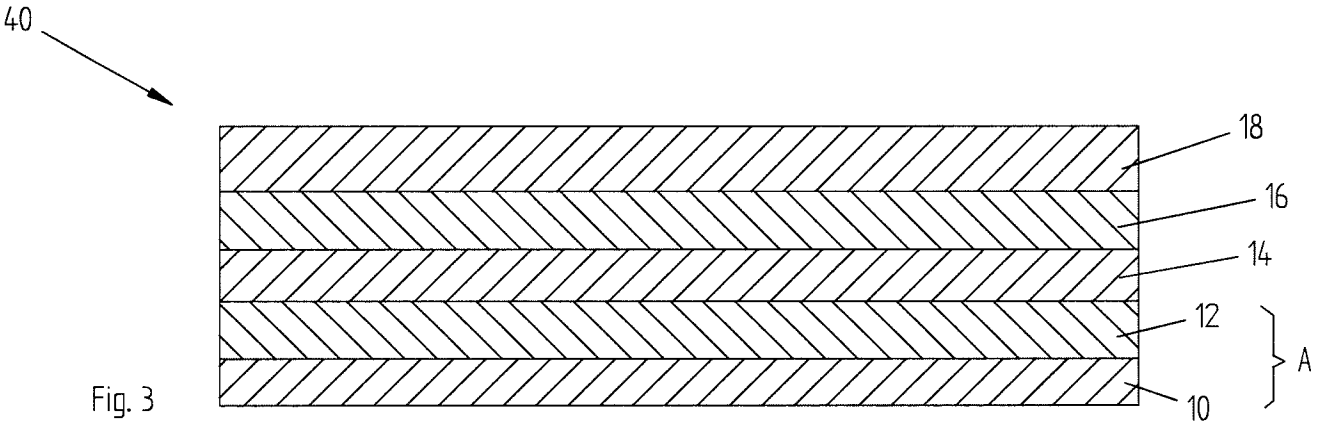
FIG. 3 shows a sectional view of a semi-finished product obtained in an intermediate step of the process illustrated in FIG. 1.

In FIG. 1 the reference numeral 2 identifies a first coil on which a preparation is wound which is indicated as a whole by A and shown in the detailed view of FIG. 1A and in FIG. 3. The preparation A preferably comprises a coating support 10 and a thermo-adhesive layer 12. The coating support 10 serves the function of enabling the successive processing steps to be carried out in the system 1, which is provided with coating stations, as described below. In a successive step of the method, therefore, said coating support 10 will be removed in order to be eliminated or recovered and successively re-used. Preferably, the coating support 10 comprises a paper film, more preferably a siliconised paper film. For example, the coating support 10 has a thickness of 140 micrometers. In variant embodiments, said coating support may comprise different materials, for example a film in polyethylene terephthalate (PET) and/or polypropylene (PP) or in general any material suited to be used in a coating process.

The thermo-adhesive layer 12 is preferably pre-coupled with the coating support, preferably in a special unit located upstream of the system 1. Preferably, the thermo-adhesive layer 12 comprises a thermoplastic layer, preferably a copolyester resin-based or polyurethane-based thermoplastic layer, which essentially has the function of allowing the item 50 to be applied through adhesion to fabrics or clothing items in general (as is described below). The thermo-adhesive layer 12, for example, has a thickness of 55 micrometers. In variant embodiments, the thermo-adhesive layer may comprise different materials, such as TPU, LDPE, acrylic, PA, PU, silicone, rubber, etc. While in the embodiment illustrated herein the preparation A is pre-coupled and feeds the system 1, in a variant embodiment the preparation A may be made in a special unit of the system 1 itself, for example through a coating station that applies the thermo-adhesive layer to a suitable coating support.

The system 1 preferably comprises a conveyor belt 4, through which the preparation A is unwound from the first coil 2 and made advance in the direction of advance indicated by the arrow, that is, from left to right in FIG. 1. Three coating stations 1B, 1C, 1D are installed in succession along the belt 4 for the formation of superimposed layers respectively indicated by the reference numerals 14, 16 and 18. More specifically, the formation of the layers 14, 16 and 18 takes place as explained below.

With the preparation A advancing from left to right as shown in FIG. 1, the first coating station 1B is activated in order to spread an intermediate layer 14, commonly defined also skin layer, on the preparation A.

The skin layer 14 preferably comprises a white material and serves to ensure the opacity of the item 50 and define a white base, so that it can then be used on fabrics in any color.

The skin layer 14 preferably comprises polyurethane-based materials, preferably PU, or acrylic-based materials, or PVC, or LDPE.

The skin layer 14 preferably comprises also pigments, dye and/or rheologic agents. Furthermore, the skin layer 14 advantageously serves as a bridge between the thermo-adhesive layer 12 and the layers that will be formed on top of it and are described here below. The fact that the skin layer 14 serves the function of a bridge improves the mechanical connection between the thermo-adhesive layer 12 and the adjacent layers formed on top of it. The skin layer 14, for example, has a thickness of 40 micrometers.

According to the invention, however, in the case where it is not desirable to have an opaque base, it will be possible to use a skin layer that is not necessarily white, but can even be transparent, or said layer 14 can even be omitted. In this case, the system may not be equipped with the first coating station 1B. Obviously, the final item will not be provided with a skin layer, either.

The coating station 1B preferably comprises a coating blade 1Bt suited to receive the material that will make up the skin layer 14. An amalgam of the materials making up the skin layer 14 is spread on the preparation A by means of the coating blade 1Bt.

Depending on the composition of the skin layer 14, the station 1B may comprise further accessories (not represented in the figure) that are suited, for example, to heat the amalgam of the components or even to mix the amalgam, so as to guarantee the desired fluidity. After leaving the station 1B, the amalgam is heated (dried) by means of an oven 2B, so as to form a continuous layer B. Two layers 16 and 18, the so-called finish layers, which are suited to receive the sublimation inks, are formed in respective successive coating stations 1C and 1D.

In the embodiment illustrated and described herein there are two finish layers 16 and 18. However, in a variant embodiment there can be a single finish layer obtained through a single respective coating station. In one embodiment, the two layers 16 and 18 have the same, or essentially the same composition and/or thickness. According to one aspect, the finish layer/s 16, 18 preferably comprises/comprise polyester powder and/or polyamide powder incorporated in a matrix made of a polymeric material. In one embodiment, the polyester powder comprises polybutylene terephthalate powder (PBT) and/or polyethylene terephthalate powder (PET), or mixtures of the same. In one embodiment, the polyamide powder comprises PA6 and/or PA66 and/or PA666 powder, or mixtures of the same.

In one embodiment, the finish layer/layers 16, 18 comprises/comprise only polyester powder. In another embodiment, the finish layer/layers 16, 18 comprises/comprise only polyamide powder. In a further embodiment, the finish layer/layers 16, 18 comprises/comprise both polyester powder and polyamide powder. Polyamide powder is preferably present in a percentage included between 20% and 80% with respect to the polyester powder. In one embodiment, the polyester powder and/or the polyamide powder has/have a grain size of less than 500 micrometers, more preferably a grain size of less than 200 micrometers, even more preferably a grain size of less than 75 micrometers.

In one embodiment, the grains of the polyester powder and/or polyamide powder have the shape of polyhedra. Preferably, the matrix made of a polymeric material comprises polymers of polyurethane and/or acrylic resin and/or vinyl resins, or mixtures of the same. Polyester powder and/or polyamide powder, more specifically polybutylene terephthalate powder (PBT) and/or polyethylene terephthalate powder (PET) and/or PA powder is/are present in a weight percentage included between 20% and 80% with respect to said matrix made of a polymeric material, more preferably between 40% and 70%. For example, the finish layers 16, 18 have an overall thickness included between 70 and 90 micrometers (for example a thickness included between 35 and 45 micrometers for each finish layer 16, 18).

The coating stations 1C and 1D preferably comprise respective coating blades 1Ct and 1Dt suited to receive the material that will make up the finish layers 16 and 18. An amalgam of the materials making up the first finish layer 16 is spread on the previous continuous layer B by means of the coating blade 1Ct, in such a way as to form the first finish layer 16. Depending on the composition of the first finish layer 16, the station 1C may comprise further accessories (not represented in the figure) that are suited, for example, to heat the amalgam of the components or even to mix the amalgam, so as to guarantee the desired fluidity.

After leaving the station 1C, the amalgam is heated (dried) by means of an oven 2C so as to form a continuous layer C. An amalgam of the materials making up the second finish layer 18, that is, the most external layer, is spread on the previous continuous layer C by means of the successive coating blade 1Dt, in such a way as to form the second finish layer 18.

Depending on the composition of the second finish layer 18, the station 1D may comprise further accessories (not represented in the figure) that are suited, for example, to heat the amalgam of the components or even to mix the amalgam, so as to guarantee the desired fluidity. After leaving the station 1D, the amalgam is heated (dried) by means of an oven 2D so as to form a continuous layer D.

In one embodiment, the amalgam of which the first and/or the second finish layer/s 16, 18 is/are made is obtained by mixing polyester powders dispersed in a solvent, for example dimethylformamide solvent (DMF) and methoxypropanol solvent (MP), and incorporated in the matrix made of a polymeric material, preferably acrylic resin pre-dispersed in ethyl acetate. In another embodiment, the amalgam of which the first and/or the second finish layer/s 16, 18 is/are made is obtained by mixing polyamide powders dispersed in a solvent, for example dimethylformamide solvent (DMF) and methoxypropanol solvent (MP), and incorporated in the matrix made of a polymeric material, preferably acrylic resin pre-dispersed in ethyl acetate. The coating process of the finish layers 16 and 18 preferably includes the application of a quantity of material respectively equal to 45 g/m$^2$ and 45 g/m$^2$ in dry conditions. The product D leaving the station 1D constitutes a semi-finished stratified product 40, represented in particular in FIG. 3. The semi-finished stratified product 40 is preferably wound on a special coil 6. The coating support 10 is removed from the semi-finished stratified product, preferably from the coil 6 on which it was wound. The coating support 10 is preferably wound on a special coil 200 and recovered in order to be successively re-used. Alternatively, the coating support 10 can be recycled or even discarded.

Figure 4:
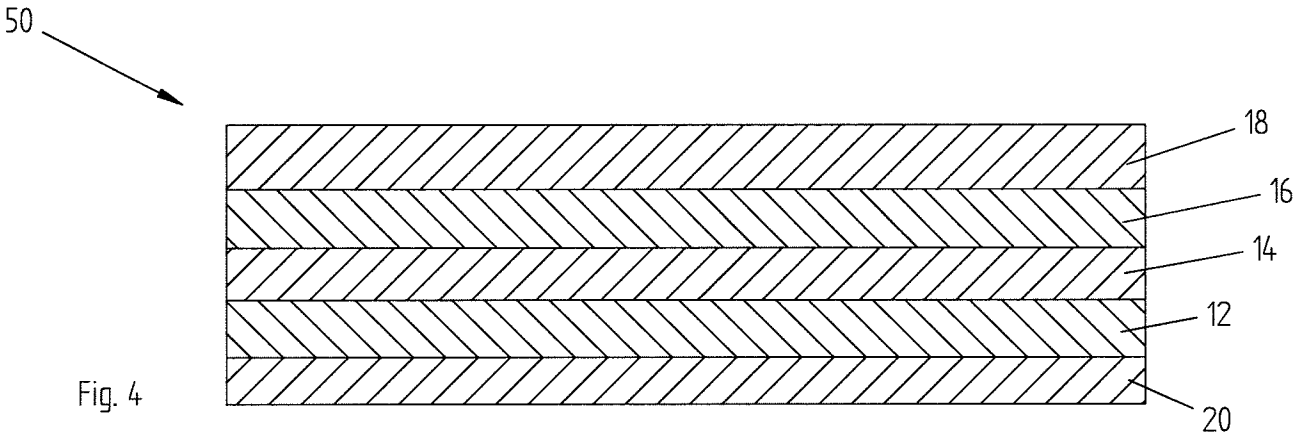
FIG. 4 shows a sectional view of the support item of FIG. 2 obtained by means of the process illustrated in FIG. 1.

In a successive step, a new support layer 20 is applied to the semi-finished stratified product 40 without the coating support 10, in order to obtain the final item 50, as shown in FIG. 4. In one embodiment, as shown in FIG. 1, the support layer 20 is applied after being unwound from a special coil 202. Preferably, the final item 50 is wound on a special coil 204, too, and it is ready to be successively used and/or cut to size, for example in A4 sheets. The support layer 20 may comprise a polyester-based material. In variant embodiments the support layer may comprise different materials, such as paper, polypropylene (PP), etc. The support layer 20 has the function of facilitating the printing operations to be carried out on the item 50, more specifically on the external finish layer 18, for example of facilitating the insertion and the removal of the item 50 into and from a printer for sublimation inks (FIG. 5).

To sum up, the item 50 comprises a stratified structure in which the layers have the following characteristics: the support layer 20 preferably comprises a polyester-based material, having preferably the function of enabling the item 50 to be used in printers for sublimation inks; the overlying layer 12 comprises a thermo adhesive film, preferably a copolyester resin-based or polyurethane resin-based thermo-adhesive film, essentially having the function of allowing application through adhesion to fabrics or clothing items in general (see the description below); the overlying layer 14 constitutes a so-called skin layer having the function of making the item 50 opaque during printing on fabrics in any color and of giving substance and strength to the material, improving its mechanical characteristics; the finish layers 16, 18, more specifically the external finish layer 18, have the purpose of receiving and holding the sublimation inks, guaranteeing good print resolution and making the material pleasant to the touch, in addition to maintaining its main characteristics.

Figure 5:
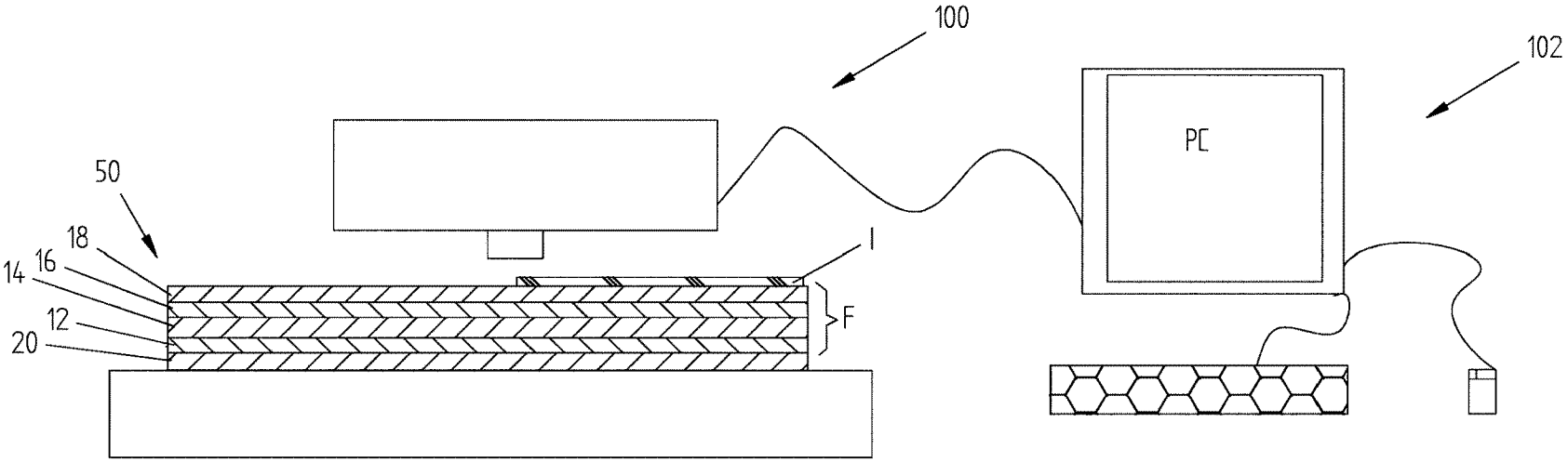
FIG. 5 shows the step of printing an embodiment of the support item.
Figure 6:
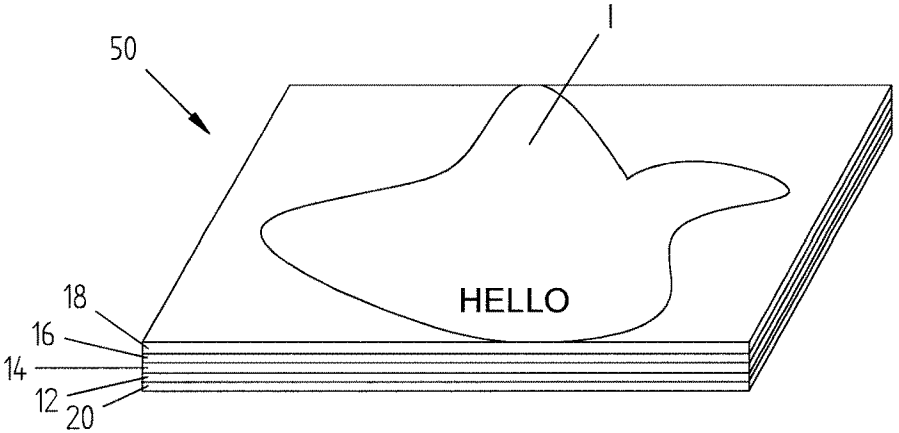

The item 50 made as described above is suited to be printed, for example as shown in FIG. 5, using a printer 100, for example managed by a computer 102, wherein during the printing process a decoration, for example the word "HELLO" shown in FIG. 6, is transferred on the external finish layer 18 by applying inks I.

During a successive step, the item 50 with the print on it can possibly be trimmed, preferably with the aid of a cutting plotter, in order to obtain an item with the desired contours.

Figure 7:
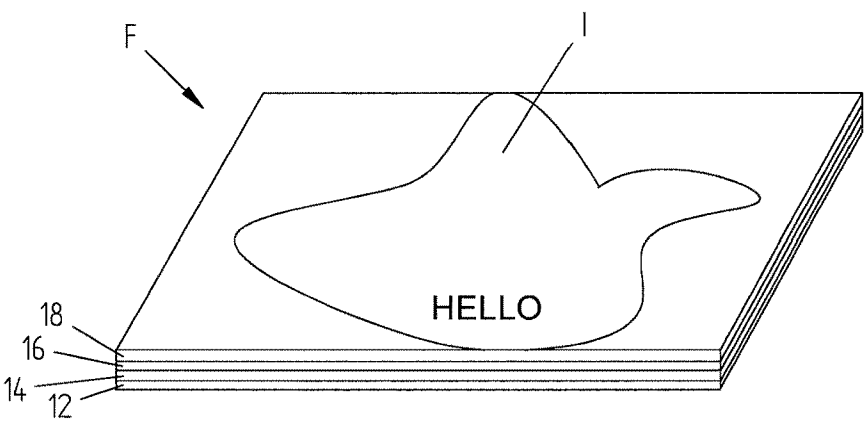
FIGS. 6 to 8 show the finishing steps in which an embodiment of the support item is used.

The support layer 20 is then removed from the item 50 with the print on it, as shown in FIG. 7, thus obtaining an item F ready to be applied, for example, to a fabric or clothing item M.

Figure 8:
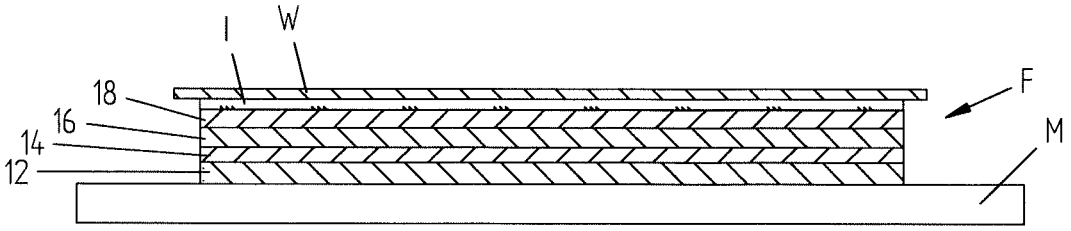
Figure 9:
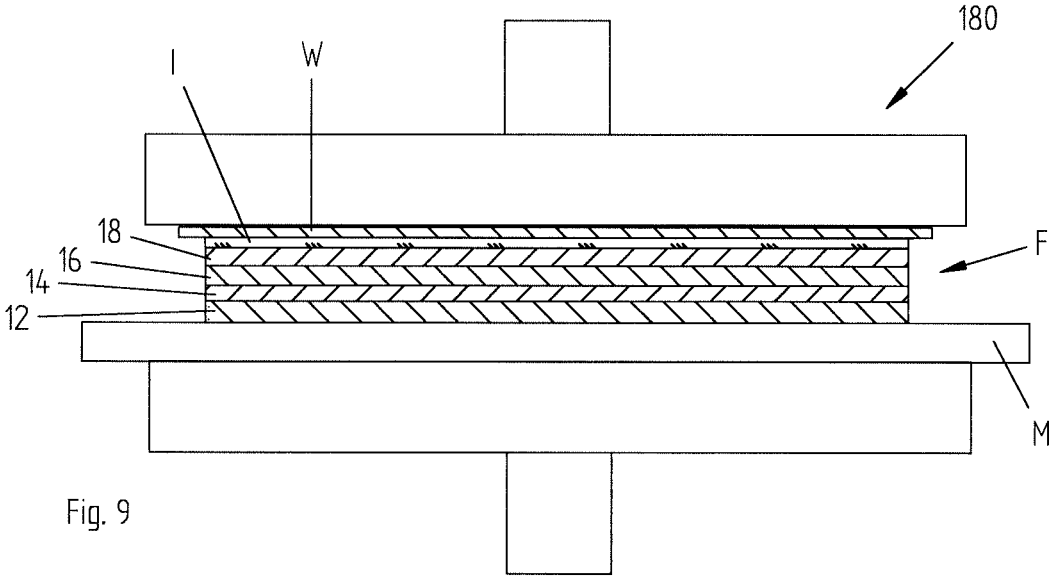
FIG. 9 shows a step of application of an embodiment of the support item to a clothing item.

The application of the item F to a clothing item (T-shirt) M is schematically represented in FIGS. 8 and 9 and comprises a first step (FIG. 8) in which the item F (with the inks I applied to the finish layer 18) is arranged at the level of the desired portion of the clothing item M. This last operation is carried out with the aid of an adhesive support W, preferably in a silicone-based or acrylic-based or rubber-based material, which raises the item F and makes it easier to position it on the fabric M.

In a successive step (FIG. 9) the item F is fixed to the clothing item M through the application of heat and pressure in a special press 180.

More specifically, during this last step, the thermo-adhesive layer 12 is softened/melted and transferred (at least partially) onto the clothing item M, thus impregnating it, wherein, then, the subsequent cooling and hardening of the item (of the previously softened/melted layer) results in the definitive fixing of the same to the clothing item M. It should also be noted that the application of heat leads to the further result of fixing the sublimation inks to the external finish layer 18 and to the first finish layer 16. In this way the inks acquire resistance, specifically to washing, even at high temperatures, as well as brightness and color.

According to an advantageous aspect of the present invention, thanks to the particular composition of the finish layers 16, 18, and especially to the presence of the grains that make up the polyester and/or polyamide powder with respective reduced softening/melting temperatures, makes it possible to entrap the inks at lower application temperatures compared to the known techniques, protecting also the most delicate fabrics.

The item 50 carried out according to the present invention, in fact, makes it possible to obtain the results described above (softening/melting and transfer of the thermo-adhesive layer 12 and activation of the inks I) at considerably lower temperatures than those required for the items made according to the known technique. Preferably, the operating temperatures of the press 180 can lie within a range included between 150° C. and 200° C. For example, the pressing step can take place at a temperature within that range for a period of time of approximately 15 seconds at a pressure of 3 bars).

Once the press 180 has been opened, the adhesive support W is removed.

Figure 10:
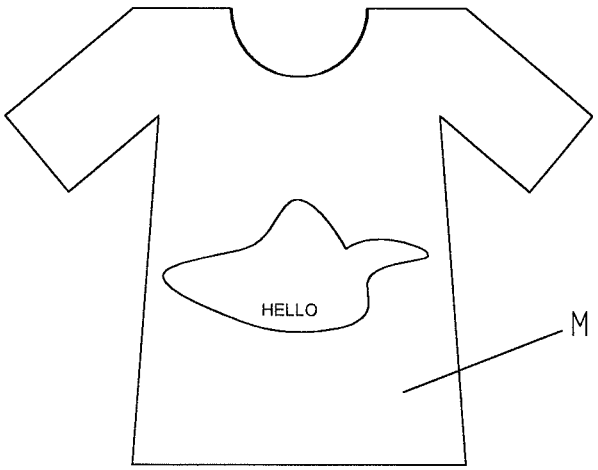
FIG. 10 shows an object obtained using an embodiment of the support item.

The reduced temperatures obviously have a lower impact on the fabric or clothing item, which is subject to lower thermal stress, with considerable advantages in the case of clothing items in cotton, wool or similar materials. The result is thus that represented in FIG. 10, that is, a clothing item M decorated with the item 50.

According to a further advantageous aspect of the present invention, thanks to the particular composition of the finish layers 16, 18, and more specifically to the presence of the polyester and/or polyamide granules, the item 50 has a good elasticity, which makes it easy to process in the cutting steps, especially favouring the use of a cutting plotter and avoiding manual trimming operations. According to another advantageous aspect of the present invention, thanks to the particular composition of the finish layers 16, 18, and more specifically to the presence of the polyester and/or polyamide granules, the item 50 can be used for printing objects made of any material.

The polybutylene terephthalate powder or the polyamide powder preferably used according to the present invention is preferably obtained starting from granules of the same material, which are ground and micronized inside a cryogenic mill with pins or hammers which exploits the fragility of the plastic powder following rapid crystallization in liquid nitrogen. In order to favour the grinding process, sliding agents and silica ($SiO_2$) are often added, traces of which can be found in the ground product. The micronized powder is then sieved in order to recover only the powder having the desired grain size. The coarser residues are ground again and then sieved. Preferably, the micronized powder obtained with this method has a polyhedric shape.

It has thus been shown, by means of the preceding detailed description of the embodiment of the present invention illustrated in the drawings, that the present invention makes it possible to achieve the desired results while at the same time minimizing the drawbacks observed in the known technique.

It should also be noted that, even if the present invention has been illustrated by means of the preceding detailed description of its embodiment represented in the drawings, the present invention is not limited to the embodiment described above and represented in the drawings. On the contrary, all the variants and modifications of the embodiment described and represented herein which are clear and obvious for the expert in the art fall within the scope of the present invention. For example, as already mentioned above, the skin layer can be omitted, according to the needs and/or circumstances. Furthermore, also the thickness of each one of the layers can be selected according to the needs and/or circumstances. Again, the system can have different characteristics. For example, the invention may comprise alternative coating stations to the one illustrated and described above, for example coating stations for reverse roller coating, synchro roller coating, or coating with photo-engraved cylinder. Other techniques may consist in the "deposition" of the polyester powder and/or the polyamide powder 30 on the polymeric matrix or in a mixture spraying technique.

Furthermore, it should be specified that the system and the execution method illustrated and described above represent one embodiment for the execution of the item according to the present invention. In variant embodiments, however, the layers of the item can be made and coupled together using systems and corresponding methods different from those described herein. Therefore, the execution of the succession of layers of the item and their mutual coupling can be different from those previously described above. For example, the finish layers may be the first to be made, for example through a coating process on a special coating layer, and this step may be followed by the coupling of a thermos adhesive layer, for example through a coating and/or thermal coupling process.

The scope of the present invention is then defined in the claims that follow.

The invention claimed is:

1. A stratified support item capable of being printed on with sublimation inks, comprising:

a thermo-adhesive layer configured to adhere to a surface of an object; and at least one finish layer configured to receive said sublimation inks, wherein said finish layer includes a powder comprised of a polyester and having polyhedral-shaped grains, incorporated in a matrix of polymeric material.

2. The stratified support item of claim 1, wherein said powder comprises polybutylene terephthalate powder (PBT) and/or polyethylene terephthalate powder (PET).

3. The stratified support item of claim 1, wherein said matrix of polymeric material includes at least one from the group of: (i) polyurethane, (ii) acrylic resin, and (iii) vinyl resin polymers.

4. The stratified support item of claim 1, wherein said powder comprises between 20% and 80% by weight relative to said matrix of polymeric material.

5. The stratified support item of claim 1, wherein said powder comprises between 40% and 70% by weight relative to said matrix of polymeric material.

6. The stratified support item of claim 1, further comprising a support layer in contact with said thermo-adhesive layer.

7. The stratified support item of claim 1, wherein said thermo-adhesive layer comprises a thermoplastic layer.

8. The stratified support item of claim 7, wherein said thermoplastic layer includes at least one from the group of (i) a copolyester resin and (ii) a polyurethane resin.

9. The stratified support item of claim 1, further including an intermediate skin layer in contact with said thermo-adhesive layer and said finish layer.

10. The stratified support item of claim 9, wherein said intermediate skin layer comprises a polyurethane-based material.

11. The stratified support item of claim 10, wherein said polyurethane-based material comprises at least one from the group of: (i) PU, (ii) acrylic materials, (iii) PVC, and (iv) LDPE.

12. The stratified support item of claim 1, wherein said powder has a grain size of less than 500 micrometers.

13. The stratified support item of claim 1, wherein said powder has a grain size of less than 200 micrometers.

14. The stratified support item of claim 1, wherein said powder has a grain size of less than 75 micrometers.

15. A stratified support item for decorating an object made according to the following process:

providing a thermo-adhesive layer;

forming a finish layer from an amalgam comprised of a powder comprising at least a polyester powder having polyhedral-shaped grains; and coupling said thermo-adhesive layer and said finish layer.

16. A stratified support item capable of being printed on with sublimation inks, comprising:

a thermo-adhesive layer configured to adhere to a surface of an object; and at least one finish layer configured to receive said sublimation inks, wherein said finish layer includes a powder comprised of polybutylene terephthalate powder (PBT) and having polyhedral-shaped grains, incorporated in a matrix of polymeric material.

17. The stratified support item of claim 16, wherein said matrix of polymeric material includes at least one from the group of: (i) polyurethane, (ii) acrylic resin, and (iii) vinyl resin polymers.

18. The stratified support item of claim 16, wherein said powder comprises between 20% and 80% by weight relative to said matrix of polymeric material.

19. The stratified support item of claim 16, wherein said powder comprises between 40% and 70% by weight relative to said matrix of polymeric material.

20. The stratified support item of claim 16, further comprising a support layer in contact with said thermo-adhesive layer.

21. The stratified support item of claim 16, wherein said thermo-adhesive layer comprises a thermoplastic layer.

22. The stratified support item of claim 21, wherein said thermoplastic layer includes at least one from the group of (i) a copolyester resin and (ii) a polyurethane resin.

23. The stratified support item of claim 16, further including an intermediate skin layer in contact with said thermo-adhesive layer and said finish layer.

24. The stratified support item of claim 23, wherein said intermediate skin layer comprises a polyurethane-based material.

25. The stratified support item of claim 24, wherein said polyurethane-based material comprises at least one from the group of: (i) PU, (ii) acrylic materials, (iii) PVC, and (iv) LDPE.

26. The stratified support item of claim 16, wherein said powder has a grain size of less than 200 micrometers.

27. The stratified support item of claim 16, wherein said powder has a grain size of less than 75 micrometers.

* * * * *